US006686511B2

(12) United States Patent
Miller et al.

(10) Patent No.: US 6,686,511 B2
(45) Date of Patent: Feb. 3, 2004

(54) PROCESS FOR MAKING A LUBE BASE STOCK FROM A LOWER MOLECULAR WEIGHT FEEDSTOCK USING AT LEAST TWO OLIGOMERIZATION ZONES

(75) Inventors: Stephen J. Miller, San Francisco, CA (US); Dennis J. O'Rear, Petaluma, CA (US); Thomas V. Harris, Benicia, CA (US); Russell R. Krug, Novato, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 213 days.

(21) Appl. No.: 09/758,897

(22) Filed: Jan. 11, 2001

(65) Prior Publication Data

US 2001/0004972 A1 Jun. 28, 2001

Related U.S. Application Data

(63) Continuation-in-part of application No. 09/470,053, filed on Dec. 22, 1999, now Pat. No. 6,398,946.

(51) Int. Cl.[7] ..... C07C 2/12

(52) U.S. Cl. ..... 585/519; 585/502; 585/518; 585/517; 585/531; 585/533; 208/18; 208/19

(58) Field of Search ..... 208/18, 19, 531; 585/502, 510, 517, 518, 519, 520, 533, 601

(56) References Cited

U.S. PATENT DOCUMENTS

| | | | | |
|---|---|---|---|---|
| 3,315,009 A | * | 4/1967 | Engelbrecht et al. | 260/683.15 |
| 3,402,217 A | * | 9/1968 | Engelbrecht et al. | 260/683.15 |
| 3,763,244 A | * | 10/1973 | Shubkin | 260/676 R |
| 3,852,207 A | | 12/1974 | Stangeland et al. | |

(List continued on next page.)

FOREIGN PATENT DOCUMENTS

| | | |
|---|---|---|
| EP | 225 053 B1 | 10/1986 |
| EP | 464 546 B1 | 6/1991 |
| EP | 582 347 B1 | 7/1993 |
| EP | 659 478 B1 | 12/1994 |
| EP | 791 643 A1 | 2/1997 |
| WO | WO 96/13563 | 10/1994 |
| WO | WO 96/26993 | 12/1995 |

OTHER PUBLICATIONS

U.S. patent application No. 09/758,813, O.'Rear, et al., *A Process for Making a Lube Base Stock From a Lower Molecular Weight Feedstock,* Filed on Jan. 11, 2001.

U. S. patent application No. 09/758,667, Krug, R. and O'Rear, D., *A Process for Making a Lube Base Stock From a Lower Molecular Weight Feedstock in a Catalytic Distillation Unit,* Filed on Jan. 11, 2001.

Dornte, R. W., *Oxidation of White Oils, Industrial and Engineering Chemistry,* Industrial Edition, Jan. 1936, vol. 28, No. 1, Published by American Chemical Society, Easton, PA. pp. 26–30.

Endeby, J. E., "Ionic liquids: recent progress and remaining problems", *J. Phys.Condensed Matter,* vol. 5, Supp.34B, pp. B99–B106, Institute of Physics Publishing, U.K. (1993).

(List continued on next page.)

*Primary Examiner*—Bekir L. Yildirim
(74) *Attorney, Agent, or Firm*—Burns, Doane, Swecker & Mathis, L.L.P.

(57) ABSTRACT

A process for making a lube base stock wherein an olefinic feedstock is separated into a light olefin fraction and a medium olefin fraction. The light olefin fraction is contacted with a first oligomerization catalyst in a first oligomerization zone to produce a first product. Both the medium olefin fraction and the first product are contacted with a second oligomerization catalyst in a second oligomerization zone to produce a second product. The second product is separated into a light byproduct fraction and a heavy product fraction that includes hydrocarbons in the lube base stock range.

20 Claims, 1 Drawing Sheet

U.S. PATENT DOCUMENTS 3,904,513 A 9/1975 Fischer et al.
4,045,507 A * 8/1977 Cupples et al. ..... 260/683.15 B
4,157,294 A 6/1979 Iwao et al.
4,232,177 A 11/1980 Smith, Jr.
4,307,254 A 12/1981 Smith, Jr.
4,336,407 A 6/1982 Smith, Jr.
4,401,556 A 8/1983 Bezman et al.
4,413,153 A * 11/1983 Garwood et al. ..... 585/304
4,417,088 A 11/1983 Miller ..... 585/533
4,523,045 A 6/1985 Vora
4,523,048 A 6/1985 Vora
4,527,004 A * 7/1985 Sweeney ..... 585/851
4,542,251 A 9/1985 Miller ..... 585/533
4,608,450 A 8/1986 Miller ..... 585/517
4,657,661 A 4/1987 Miller
4,678,645 A * 7/1987 Chang et al. ..... 422/190
4,820,402 A 4/1989 Partridge et al.
4,855,524 A 8/1989 Harandi et al. ..... 585/517
4,913,799 A 4/1990 Gortsema et al.
4,962,249 A 10/1990 Chen et al. ..... 585/329
5,012,021 A 4/1991 Vora et al.
5,015,361 A 5/1991 Anthes et al. ..... 208/111
5,049,536 A 9/1991 Bellussi et al. ..... 502/235
5,059,567 A 10/1991 Linsten et al.
5,073,530 A 12/1991 Bezman et al.
5,080,878 A 1/1992 Bowes et al. ..... 423/328
5,082,986 A 1/1992 Miller ..... 585/667
5,114,563 A 5/1992 Lok et al.
5,132,477 A * 7/1992 Ho et al. ..... 585/467
5,135,638 A 8/1992 Miller ..... 208/27
5,146,022 A 9/1992 Buchanan et al. ..... 585/12
5,171,908 A * 12/1992 Rudnick ..... 585/255
5,171,909 A 12/1992 Sanderson et al. ..... 585/255
5,198,203 A 3/1993 Kresge et al.
5,198,597 A 3/1993 O'Young et al.
5,243,112 A 9/1993 Chester et al. ..... 585/12
5,246,566 A 9/1993 Miller ..... 208/27
5,246,689 A 9/1993 Beck et al.
5,270,273 A 12/1993 Pelrine et al. ..... 502/60
5,276,229 A 1/1994 Buchanan et al. ..... 585/255
5,282,958 A 2/1994 Santilli et al. ..... 208/111
5,334,368 A 8/1994 Beck et al.
5,382,739 A * 1/1995 Atkins et al. ..... 585/530
5,453,556 A 9/1995 Chang et al. ..... 585/524
5,502,018 A 3/1996 Chauvin et al.
5,550,304 A 8/1996 Chauvin et al.
5,723,716 A 3/1998 Brandes et al. ..... 585/734
5,741,759 A 4/1998 Gee et al.
5,866,746 A 2/1999 Didillion et al.
5,965,783 A 10/1999 Gee et al.
6,008,164 A 12/1999 Aldrich et al. ..... 508/110
6,025,533 A 2/2000 Vora et al. ..... 585/330
6,147,271 A * 11/2000 Strebel et al. ..... 585/520
6,288,296 B1 * 9/2001 Miller et al. ..... 585/510

OTHER PUBLICATIONS

Malz Jr., Richard, "Catalysis of Organic Reactions", 68, pp 249–263, Marcel Dekker, Inc., New York, (1996).
Seddon, K. R., "Ionic Liquids for Clean Technology", *J.Chem. Tech.Biotechnol.,* 68: 351–356, John Wiley & Sons Ltd., UK.(1997).

* cited by examiner

PROCESS FOR MAKING A LUBE BASE STOCK FROM A LOWER MOLECULAR WEIGHT FEEDSTOCK USING AT LEAST TWO OLIGOMERIZATION ZONES

RELATED APPLICATIONS

This application is related to "A Process For Making A Lube Base Stock From A Lower Molecular Weight Feedstock," filed concurrently with this application, which is a continuation-in-part of U.S. Ser. No. 09/470,053, titled "A Process For Making A Lube Base Stock From A Lower Molecular Weight Feedstock," filed Dec. 22, 1999 now U.S. Pat. No. 6,398,946. This application is also related to "A Process For Making A Lube Base Stock From A Lower Molecular Weight Feedstock In A Catalytic Distillation Unit," filed concurrently with this application, and to "Use of a Hydrogen-containing Gas Stream to Retard Fouling of Preheat Exchangers in Fischer-Tropsch Products Hydroprocessing," also filed concurrently with this application.

FIELD OF THE INVENTION

The present invention relates to a process for making a lube base stock from olefin-containing feedstocks having lower molecular weights than the lube base stock, using more than one oligomerization zone. Included in this invention is a process for making predominately bright stock lube base stock.

BACKGROUND OF THE INVENTION

Lubricant oils of high viscosity and high oxidation stability are desirable. Such materials can be prepared by hydrocracking, hydroisomerizing and otherwise hydroprocessing various wax fractions and by polymerizing normal alpha olefins such as 1-decene. The former route has the advantage of moderate costs, but the oxidation stability is not exceptional. As attempts are made to improve the oxidation stability by increasing the severity of the hydroprocessing steps, the yield of lube declines, as does its viscosity. The latter route gives an exceptionally stable product, but suffers the disadvantage of high cost. It would be desirable to provide new processes for generating high viscosity and highly stable products. The present invention provides such a process.

U.S. Pat. No. 6,025,533 to Vora et al. ("Oligomer Production with Catalytic Distillation") teaches production of heavy oligomers ($C_7$+ oligomers) from $C_4$ paraffins and olefins by a combination of dehydrogenation and oligomerization. The process has at least one catalyst bed in the top of a distillation column for separating the oligomerization effluent of the dehydrogenation and oligomerization combination.

U.S. Pat. No. 5,276,229 to Buchanan et al. ("High VI Synthetic Lubricants From Thermally Cracked Slack Wax") teaches oligomerizing alpha-olefins produced from thermal cracked slack wax.

U.S. Pat. No. 5,015,361 to Anthes et al. ("Catalytic Dewaxing Process Employing Surface Acidity Deactivated Zeolite Catalysts") teaches oligomerization of propylene in two stages using ZSM-23 and ZSM-5 to form a low pour point, high cloud point product, followed by dewaxing.

U.S. Pat. No. 4,855,524 to Harandi et al. ("Process For Combining the Operation of Oligomerization Reactors Containing a Zeolite Oligomerization Catalyst") teaches combining the operation of a primary reactor that oligomerizes a $C_{3-7}$ feed to gasoline range hydrocarbons and a high pressure secondary reactor that oligomerizes the effluent of the first reactor to make distillate or lubes.

U.S. Pat. No. 4,678,645 to Chang et al. ("Conversion of LPG Hydrocarbons to Distillate Fuels or Lubes Using Integration of LPG Dehydrogenation and MOGDL") teaches converting $C_4$- paraffins to higher hydrocarbons by the combination of catalytic or thermal dehydrogenation of a paraffinic feedstock to produce olefins and conversion of olefins to gasoline and distillate boiling range materials in a low pressure oligomerization catalytic reactor and a high pressure oligomerization catalytic reactor.

U.S. Pat. No. 4,608,450 to Miller ("Two-Stage Multiforming of Olefins to Tetramers") teaches a two-stage process for preparing a C3 or C4 olefin tetramer using nickel-containing HZSM-5 zeolite catalyst.

A variety of patents disclose catalysts useful for oligomerization.

U.S. Pat. No. 5,453,556 to Chang et al. ("Oligomerization Process For Producing Synthetic Lubricants") teaches an oligomerization process using a catalyst having an acidic solid with a Group IVB metal oxide modified with an oxyanion of a Group VIB metal.

U.S. Pat. No. 5,270,273 to Pelrine et al. ("Olefin Oligomerization Catalyst") teaches an olefin oligomerization catalyst having a supported, reduced Group VIB metal oxide on an inorganic support, such as MCM-41.

U.S. Pat. No. 5,243,112 to Chester et al. ("Lubricant Range Hydrocarbons From Light Olefins") teaches oligomerizing an olefinic feedstock over a medium pore zeolite catalyst (HZSM-22).

U.S. Pat. No. 5,171,909 to Sanderson et al. ("Synthetic Lubricant Base Stocks From Long-Chain Vinylidene Olefins and Long-Chain Alpha- and/or Internal-Olefins") teaches oligomerization of long-chain olefins using certain acidic montmorillonite clay catalysts.

U.S. Pat. No. 5,146,022 to Buchanan et al ("High VI Synthetic Lubricants From Cracked Slack Wax") teaches oligomerizing with a Lewis acid catalyst a mixture of $C_5$–$C_{18}$ or $C_6$–$C_{16}$ alpha-olefins produced from thermal cracking of slack wax.

U.S. Pat. No. 5,080,878 to Bowes et al. ("Modified Crystalline Aluminosilicate Zeolite Catalyst and Its Use in the Production of Lubes of High Viscosity Index") teaches oligomerization with a modified zeolite (ZSM-5, ZSM-11, ZSM-12, ZSM-22, ZSM-23, ZSM-35, ZSM-38, or ZSM-48).

U.S. Pat. No. 4,962,249 to Chen et al. ("High VI Lubricants From Lower Alkene Oligomers") teaches oligomerization of lower olefins with a reduced valence state Group VIB metal oxide on porous support. In one embodiment, a feedstock of lower olefins is contacted with surface deactivated, acidic, medium pore, shape selective metallosilicate catalyst under oligomerization conditions, then reacting the mixture with ethylene in contact with an olefin metathesis catalyst under metathesis conditions, then oligomerizing the metathesis product in contact with a reduced valence state Group VIB metal catalyst on porous support.

U.S. Pat. No. 4,542,251 to Miller ("Oligomerization of Liquid Olefin Over a Nickel-Containing Silicaceous Crystalline Molecular Sieve") teaches oligomerization in the liquid phase using nickel-containing silicaceous crystalline molecular sieve catalysts to produce lube base stock.

U.S. Pat. No. 4,417,088 to Miller ("Oligomerization of Liquid Olefins") teaches oligomerization of liquid olefins using intermediate pore size molecular sieves to produce lube base stock.

EP 791,643 A1 ("Lubricating Oils") teaches a process for the production of lubricating oils having a viscosity index of at least 120 and a pour point of −45 C. or less by oligomerizing a feedstock comprising one or more $C_{5-18}$ 1-oleflins in the presence of an oligomerization catalyst comprising an ionic liquid.

In conventional hydrodewaxing, the pour point is lowered by selectively cracking the longer chain wax molecules, mostly normal and slightly branched paraffins. A disadvantage associated with catalytic dewaxing is that the wax is degraded to lower molecular weight materials. For example, waxy paraffins may be cracked down to butane, propane, ethane and methane and so may branched paraffins which do not contribute to the waxy nature of the oil. It is desirable to limit the degree of cracking which takes place during a catalytic dewaxing process, because these lighter products are generally of lower value than the higher molecular weight materials, and because the viscosity index and oxidation stability of the resulting oil is degraded by the loss of paraffins.

A major breakthrough came with the discovery of new dewaxing catalysts, which were found to isomerize rather than crack the wax molecules. Isomerization alters the molecular structure of wax molecules, and generally decreases the pour point of a molecule without significantly changing its boiling point. In contrast to wax cracking, isomerized molecules are retained in the lubricating oil base stock, increasing yield of lubricating oil base stock without reducing viscosity index or oxidation stability significantly.

U.S. Pat. No. 5,135,638 to Miller ("Wax Isomerization Using Catalyst of Specific Pore Geometry") discloses a process for producing lube oil from a feedstock having greater than 50% wax. The feedstock is isomerized over a catalyst comprising a molecular sieve (e.g., SAPO-11, SAPO-31, SAPO-41, ZSM-22, ZSM-23, and ZSM-35) and at least one Group VIII metal at a pressure of from about 15 psig to about 2000 psig.

U.S. Pat. No. 5,246,566 to Miller ("Wax Isomerization Using Catalyst of Specific Pore Geometry") discloses a process similar to that of U.S. Pat. No. 5,135,638, but where the waxy feed has a pour point of above about 0 C. and contains greater than about 70% paraffinic carbon.

U.S. Pat. No. 5,282,958 to Santilli et al. ("Use of Modified 5–7 Å Molecular Sieves For Isomerization of Hydrocarbons") discloses isomerizing a feed including straight chain and slightly branched chain paraffins having 10 or more carbons using an intermediate pore size molecular sieve (e.g., SAPO-11, SAPO-31, SAPO-41, ZSM-22, ZSM-23, and ZSM-35). Feeds which may be processed by this method include waxy feeds, which contain greater than about 50% wax.

U.S. Pat. No. 5,082,986 to Miller ("Process for Producing Lube Oil From Olefins By Isomerization Over a Silicoaluminophosphate Catalyst") discloses a process for making a $C_{20}$+ lube oil from olefins or reducing the pour point of a lube oil comprising isomerizing the olefins over a catalyst an intermediate pore size silicoaluminophosphate molecular sieve and at least one Group VIII metal.

Large pore zeolites represent another class of catalysts that have been taught for wax isomerization.

EP 464,546 to Degnan et al. ("Production of high viscosity index lubricants") teaches producing a high viscosity index lubricant from a petroleum wax feed having a paraffin content of at least 40 weight percent. The catalyst is a low acidity zeolite isomerization catalyst having an alpha value of below 20. Zeolite Beta, which contains boron as a framework component of the zeolite, is taught as being preferred.

WO 96/26,993 to Apelain et al. ("Wax Hydroisomerization Process") teaches for producing a high viscosity index lubricant catalytically dewaxing waxy paraffins by isomerization in the presence of hydrogen and a low acidity large pore zeolite isomerization catalyst having a ratio of $SiO_2/Al_2O_3$, as synthesized, of at least 200:1.

WO 96/13,563 to Apelain et al. ("Wax Hydroisomerization Process") teaches an isomerization process for producing a high viscosity index lubricant using a low acidity large pore molecular sieve having a crystal size of less than 0.1 micron, an alpha value of not more than 30 and containing a noble metal hydrogenation component.

EP 225,053 to Garwood et al. ("Lubricant Production Process") teaches isomerization dewaxing using a large pore, high silica zeolite dewaxing catalyst, followed by a subsequent dewaxing step which selectively removes the more waxy n-paraffin components. The selective dewaxing step may be either a solvent or a catalyst dewaxing, preferably using a highly shape selective zeolite such as ZSM-22 or ZSM-23.

EP 659,478 to Perego et al. ("Process for Preparing Amorphous, Catalytically Active Silico-sluminas") teaches a process for producing a high VI lubricant from a waxy hydrocarbon feed by isomerization in the presence of hydrogen and a low acidity large pore molecular sieve.

Non-zeolitic catalysts are also taught for wax isomerization.

U.S. Pat. No 5,049,536 to Belussi et al. ("Catalytically Active Silica and Alumina Gel and Process For Preparing It") catalysts are described based on silica and alumina gel and their use in isomerization processes.

EP 582,347 to Perego et al. ("Catalyst for the Hydroisomerization of Long-chain N-paraffins and Process for Preparing it") teaches a bifunctional catalyst for hydroisomerization. That catalyst has at least one Group VIIIA noble metal on a calcined amorphous silica and alumina gel.

U.S. Pat. No. 5,723,716 to Brandes et al. ("Method For Upgrading Waxy Feeds Using a Catalyst Comprising Mixed Powdered Dewaxing Catalyst and Powdered Isomerization Catalyst Formed Into A Discrete Particle (LAW082)") teaches combinations of zeolitic and non-zeolitic catalyst components.

U.S. Pat. No. 6,008,164 to Aldrich et al. ("Lubricant Base Oil Having Improved Oxidative Stability") teaches a method of producing a lube base stock by separating, into a plurality of fractions based on molecular shape, a hydroisomerized hydrocarbon wax, and collecting the fractions that have a preselected oxidative stability.

U.S. Pat. Nos. 4,417,088; 4,542,251; 4,608,450; 4,678,645; 4,855,524; 4,962,249; 5,015,361; 5,049,536; 5,080,878; 5,082,986; 5,135,638; 5,146,022; 5,171,909; 5,243,112; 5,246,566; 5,270,273; 5,276,229; 5,282,958; 5,453,556; 5,723,716; 6,008,164; and 6,025,533 are hereby incorporated by reference for all purposes.

SUMMARY OF THE INVENTION

The present invention provides a process for preparing a lube base stock from a lower molecular weight olefinic feedstock via oligomerization. The process involves separating an olefinic feedstock in a first separator into fractions that include at least a light olefin fraction and a medium olefin fraction. The light olefin fraction is contacted with a first oligomerization catalyst in a first oligomerization zone to produce a first product having increased molecular weight. The product of the first oligomerization is combined with the medium olefin fraction and the combined olefins contacted with a second oligomerization catalyst in a second oligomerization zone to produce a second product having increased molecular weight. The second product is then separated in a second separator into a light byproduct fraction and a heavy product fraction, wherein the heavy product fraction can be used as a lube base stock.

Preferably, the olefinic feedstock includes at least 10% olefins, more preferably at least 30% olefins, most preferably at least 50% olefins. The boiling point of the olefinic feedstock is greater than 180° F., preferably greater than 258° F., more preferably within the range of from 2580 to 1100° F., most preferably within the range of from 258° to 650° F.

Preferably, the boiling point of the light olefin fraction is no more than 350° F., more preferably in the range of from 50° to 350° F. Preferably, the boiling point of the medium olefin fraction is in the range of from 250° to 650° F.

In one embodiment, the fractions coming off the first separator further comprise a waxy heavy fraction (preferably having boiling points of at least 650° F.). In that embodiment, the waxy heavy fraction is thermally cracked to produce addition olefins, which are separated in a third separator into an additional light olefin fraction and an additional medium olefin fraction. Preferably, the additional light olefin fraction is sent to the first oligomerization zone and the additional medium olefin fraction is sent to the second oligomerization zone.

In some embodiments, the olefinic feedstock is derived in whole or in part from the dehydrogenation of a paraffinic feedstock. The dehydrogenation can produce diolefins, which are preferably selectively hydrogenated to reduce at least a portion of the diolefins to monoolefins. The product from the first oligomerization zone may also include diolefins, which may also be selectively hydrogenated.

In one embodiment, the olefinic feedstock is produced by a Fischer-Tropsch process, either directly from the Fischer-Tropsch process or by dehydrogenation of a highly paraffinic feedstock produced by a Fischer-Tropsch process.

Preferably, the olefinic feedstock is purified to remove oxygenates and other impurities. One purification method is by hydrotreatment of that highly paraffinic feedstock. If hydrotreatment is used for purification, the hydrotreated olefinic feedstock should be dehydrogenated to replace olefins lost by the hydrotreatment process. An alternative purification method is by adsorption with acid clay. Preferably, the olefinic feedstock is dehydrated and decarboxylated to convert any alcohols or acids which may be present to olefins.

Skeletal isomerization can be used to adjust the pour and cloud point of the final product to a desired value. Skeletal isomerization can be induced at any of a number of points in the process, including (1) on an olefinic feedstock while it is being hydrotreated, (2) while the hydrotreated olefinic feedstock is being dehydrogenated, (3) in the first oligomerization zone, (4) in the second oligomerization zone, (5) while hydrofinishing the product of the second oligomerization zone, or (6) while hydrofinishing the heavy product fraction. Preferably, skeletal isomerization is induced prior to the oligomerization zone.

The first oligomerization catalyst can be the same or different as the second oligomerization catalyst. In one embodiment, the oligomerization catalysts are an inorganic oxide or a Group VIII metal on an inorganic oxide support, more preferably a Group VIII metal on a zeolitic support. The oligomerization catalysts can be nickel on ZSM-5. In an alternative embodiment, the oligomerization catalysts can include an acidic ionic liquid.

Preferably, the product from the second oligomerization zone has a number average molecular weight at least 10% higher than the olefinic feedstock, more preferably at least 20% higher than the olefinic feedstock. Preferably, the product from the second oligomerization zone is hydrofinished prior to the separation step, and/or the heavy product fraction is hydrofinished.

Preferably, at least a portion of the light byproduct fraction is recycled either to the first oligomerization zone, the second oligomerization zone, both the first and second oligomerization zones and/or to the second separator.

In one embodiment, the oligomerization zone is located within a catalytic distillation unit used to both produce the product and separate the product into a light byproduct fraction and a heavy product fraction. In that embodiment, the olefinic feedstock can also be contacted with an oligomerization catalyst in a fixed bed prior to the catalytic distillation unit. Preferably, at least a portion of the light byproduct fraction is recycled either to the catalytic distillation unit or to the fixed bed or to both the catalytic distillation unit and the fixed bed.

Preferably, the heavy products fraction has a viscosity of greater than 2 cSt at 100° C., a viscosity index of at least 80 and a pour point of less than −10° C. More preferably, the viscosity index is at least 120 and a pour point of less than −20° C. More preferably, heavy products fraction is separated into at least one of the following fractions:

a) a light lube base stock fraction having a viscosity of from 2 to 7 cSt at 100° C.;

b) a heavy lube base stock fraction having a viscosity of from 6 to 20 cSt at 100° C.; and c) a bright stock fraction having a viscosity of greater than 180 cSt at 40° C.

More preferably, the heavy product fraction is predominately a bright stock fraction having a viscosity of greater than 180 cSt at 40° C.

The production of lube base stock can be maximized by recycling substantially all of the light byproduct fraction, either to the first oligomerization zone, the second oligomerization zone, both the first and second oligomerization zones or to the second separator.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE INVENTION

Figure 1:
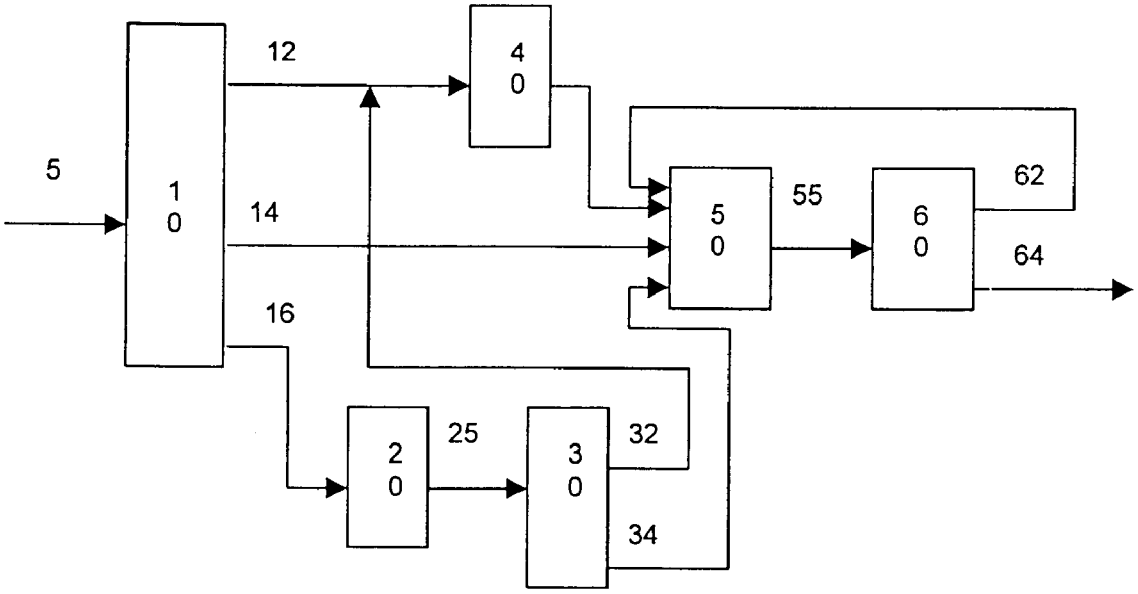
FIG. 1 shows a block diagram of a specific embodiment of a process for making a lube base stock from a lower molecular weight feedstock, wherein the production of bright stock is maximized.

In its broadest aspect, the present invention involves a process for making a lube base stock from a lower molecular weight olefinic feedstock. That process has at least four steps. A light olefin fraction and a medium olefin fraction are obtained, in one embodiment by separation of an olefinic feedstock. The light olefin fraction is contacted with a first oligomerization catalyst in a first oligomerization zone to produce a first product having an increased molecular weight relative to the light olefin fraction. The medium olefin fraction and the product from the first oligomerization zone are contacted with a second oligomerization catalyst in a second oligomerization zone to produce a second product having an increased molecular weight relative to the medium olefin fraction. (The first oligomerization catalyst can be the same as the second oligomerization catalyst, or it can be different.) That second product is separated into a light byproduct fraction and a heavy product fraction, wherein the heavy product fraction comprises a lube base stock.

As used herein the following terms have the following meanings unless expressly stated to the contrary:

The term "catalytic distillation unit" refers to a distillation unit having, within it, at least one bed of catalyst.

The term "dehydrogenation zone" refers to a reaction zone where dehydrogenation is the predominate reaction.

The term "highly paraffinic feedstock" refers to a feedstock comprising at least 50% paraffins.

The term "heavy product fraction" refers to a heavier fraction of the product from the second oligomerization zone, and contains the main product from that zone.

The term "light olefin fraction" refers to a lighter fraction of the olefinic feedstock. Preferably, the light olefin fraction has boiling points of no more than 350° F., more preferably boiling points in the range of from 50° to 350° F.

The term "additional light olefin fraction" refers to a lighter fraction of thermally cracked waxy heavy fraction.

The term "light byproduct fraction" refers to a lighter fraction of the product from the oligomerization zone, and contains byproduct from that zone. (The light byproduct fraction is lighter than the heavy product fraction.)

The term "lube base oil range" refers to materials having initial boiling points of at least 572° F. (300° C.).

The term "lube base stock" refers to hydrocarbons in the lube base oil range that have acceptable viscosity index and viscosity for use in making finished lubes. Lube base stocks are mixed with additives to form finished lubes.

The term "medium olefin fraction" refers to a fraction of the olefinic feedstock heavier than the light olefin fraction. Preferably, the medium olefin fraction has boiling points in the range of from 250° to 650° F.

The term "additional medium olefin fraction" refers to a heavier fraction of thermally cracked waxy heavy fraction.

The term "olefinic feedstock" refers to a feedstock having at least some olefins.

The term "olefinic feedstock with boiling points" refers to an olefinic feedstock wherein at least 80% of the feedstock has the given boiling points. For instance "an olefinic feedstock having boiling points greater than 180° F." refers to an olefinic feedstock wherein at least 80% of the feedstock have boiling points greater than 180° F.

The term "oligomerization catalyst" refers to a catalyst that can promote oligomerization.

The term "ligomerization zone" refers to a reaction zone containing an oligomerization catalyst. At least two oligomerization zones are used in the methods described herein.

The term "oxidation stability" refers to a test measuring resistance to oxidation by means of a Dornte-type oxygen absorption apparatus (R. W. Dornte "Oxidation of White Oils," Industrial and Engineering Chemistry, Vol. 28, page 26, 1936). Normally, the conditions are one atmosphere of pure oxygen at 340° F., and one reports the hours to absorption of 1000 milliliters of oxygen by 100 g of oil. In the Oxidator BN test, 0.8 milliliters of catalyst is used per 100 grams of oil and an additive package is included in the oil. The catalyst is a mixture of soluble metal-naphthenates simulating the average metal analysis of used crankcase oil. The additive package is 80 millimoles of zinc bis-polypropylene phenyl dithio phosphate per 100 grams of oil. The Oxidator BN measures the response of a lubricating oil in a simulated application.

The term "skeletal isomerization" refers to changing the structure of a molecule such as to increase its degree of branching without changing its molecular weight.

The term "viscosity index" refers to the measurement defined by D 2270-93.

The term "waxy heavy fraction" refers to the heaviest fraction of the olefinic feedstock. That fraction is called a waxy heavy fraction because it usually contains a high degree of waxy material.

Unless otherwise specified, all percentages are in weight percent and all molecular weights are number average molecular weights.

As defined above, the "olefinic feedstock" refers to a feedstock comprising olefins. Preferably the minimum olefin content should be at least 10%, more preferably at least 30%, most preferably at least 50%.

The boiling points of the olefinic feedstocks are greater than 180° F. Preferably, the boiling point of the olefinic feedstocks are greater than 258° F. because one can obtain, by oligomerization, a lube oil using a minimum number of monomers. This simplifies the process and avoids excessive branching in the lube oil, which reduces the viscosity index. More preferably, the boiling points are within the range of from 258° to 1100° F., most preferably within the range of from 258° to 650° F. Since typical lube oil has an initial boiling point above 650° F., oligomerizing molecules that are already in the lube oil boiling range is not usually as preferred as producing lube oil from lower boiling components.

If the olefinic feedstock has significant amounts of material with boiling points of at least 650° F., that material should form a third waxy heavy fraction. That waxy heavy fraction can be thermally cracked to produce additional olefins, which can be separated in a third separator into an additional light olefin fraction and an additional medium olefin fraction. Preferably, the additional light olefin fraction is sent to the first oligomerization zone and the additional medium olefin fraction is sent to the second oligomerization zone.

In one embodiment, the olefinic feedstock is produced by a Fischer-Tropsch process, either directly from the Fischer-Tropsch process or by dehydrogenation of a highly paraffinic feedstock produced by a Fischer-Tropsch process.

The Fischer-Tropsch reaction may be effected in a fixed bed, in a slurry bed, or in a fluidized bed reactor. The Fischer-Tropsch reaction conditions may include using a reaction temperature of between 190° C. and 340° C., with the actual reaction temperature being largely determined by the reactor configuration. Thus, when a fluidized bed reactor is used, the reaction temperature is preferably between 300° C. and 340° C.; when a fixed bed reactor is used, the reaction temperature is preferably between 200° C. and 250° C.; and when a slurry bed reactor is used, the reaction temperature is preferably between 190° C. and 270° C.

An inlet synthesis gas pressure to the Fischer-Tropsch reactor of between 1 and 50 bar, preferably between 15 and 50 bar, may be used. The synthesis gas may have a $H_2$:CO molar ratio, in the fresh feed, of 1.5:1 to 2.5:1, preferably 1.8:1 to 2.2:1. The synthesis gas typically includes 0.1 wppm of sulfur or less. A gas recycle may optionally be employed to the reaction stage, and the ratio of the gas recycle rate to the fresh synthesis gas feed rate, on a molar basis, may then be between 1:1 and 3:1, preferably between 1.5:1 and 2.5:1. A space velocity, in $m^3$ (kg catalyst)$^{-1}$hour$^{-1}$, of from 1 to 20, preferably from 8 to 12, may be used in the reaction stage.

In principle, an iron-based, a cobalt-based or an iron/cobalt-based Fischer-Tropsch catalyst can be used in the Fischer-Tropsch reaction stage. The iron-based Fischer-Tropsch catalyst may include iron and/or iron oxides which have been precipitated or fused. However, iron and/or iron oxides which have been sintered, cemented, or impregnated onto a suitable support can also be used. The iron should be reduced to metallic Fe before the Fischer-Tropsch synthesis. The iron-based catalyst may contain various levels of promoters, the role of which may be to alter one or more of the activity, the stability, and the selectivity of the final catalyst.

Preferred promoters are those influencing the surface area of the reduced iron ("structural promoters"), and these include oxides or metals of Mn, Ti, Mg, Cr, Ca, Si, Al, or Cu or combinations thereof.

The products from Fischer-Tropsch reactions performed in slurry bed reactors generally include a gaseous reaction product and a liquid reaction product. The gaseous reaction product includes hydrocarbons boiling below about 650° F. (e.g., tail gases through middle distillates). The liquid reaction product (the condensate fraction) includes hydrocarbons boiling above about 650° F. (e.g., vacuum gas oil through heavy paraffins). The products from Fischer-Tropsch reactions performed in HT reactors are generally gaseous products that can form a liquid product when a portion of the gaseous product condenses. Depending on the particular conditions, these temperatures can vary significantly, for example, with the gaseous reaction product including products with boiling points up to about 700° F.

The minus 650° F. (which can include products with boiling points up to about 700° F.) product can be separated into a tail gas fraction and a condensate fraction, i.e., about $C_5$ to $C_{20}$ normal paraffins and higher boiling hydrocarbons, using, for example, a high pressure and/or lower temperature vapor-liquid separator or low pressure separators or a combination of separators. The fraction boiling above about 650° F. (the wax fraction) primarily contains $C_{20}$ to $C_{50}$ linear paraffins with relatively small amounts of higher boiling branched paraffins.

When the gaseous reaction product from the Fischer-Tropsch synthesis step is being cooled and various fractions collected, the first fractions collected tend to have higher average molecular weights than subsequent fractions.

The presence of sulfur, nitrogen, halogen, selenium, phosphorus, and arsenic contaminants in the feedstock is undesirable. For this reason, it is preferred to remove sulfur and other contaminants from the feed before performing the dehydrogenation and oligomerization steps. Means for removing these contaminants are well known to those of skill in the art. For example, hydrotreating and adsorption on ZnO guardbeds are preferred for removing sulfur impurities. Preferably, the sulfur content is reduced below 100 ppm, most preferably below 50 ppm. Nitrogen can be removed by hydrotreating. The product nitrogen content should be below 50 ppm, preferably below 10 ppm. Means for removing other contaminants are well known to those of skill in the art.

In one embodiment, any methane produced by the reaction is recovered and converted to synthesis gas for recycling in the process. In some embodiments, the product stream may contain a relatively large amount of olefins that can be hydrogenated following the Fischer-Tropsch chemistry.

In one embodiment, the olefinic feedstock is purified in a purification zone (e.g., hydrotreated in a hydrotreating zone) to remove oxygenates and other impurities to form a treated olefinic feedstock. Such hydrotreating zones are well known in the art. Other treatments useful for removing oxygen and other impurities include, but are not limited to, adsorption (e.g., with an acid clay) and extraction.

Preferably, the olefinic feedstock is also dehydrated and decarboxylated to convert any alcohols or acids which may be present to olefins. Dehydroxylation and decarboxylation of alcohols and acids are well known. Both reactions can be effected by processing the feedstock over a catalyst, typically alumina, under moderate temperatures and pressures. The reaction of linear alcohols yields predominantly linear olefins and, and acids yield paraffins and carbon dioxide. The water and carbon dioxide can be removed from the reaction mixture by distillation.

An adsorption step may be employed to remove nitrogenous species from the feed. It is preferred that the concentration of organic nitrogen in the feed to the oligomerization step in the present process be less than about 40 ppm, preferably less than about 20 ppm. Suitable adsorbents to remove the nitrogen compounds include heterogeneous acid materials such as acidic clays, molecular sieves, and ion exchange resins. Such materials are described in U.S. Pat. No. 4,657,661 to Miller ("Process For Improving The Storage Stability And Bulk Oxidation Stability Of Lube Base Stocks Derived From Bright Stock"), hereby incorporated by reference for all purposes.

Hydrogenation catalysts can be used for the purification. For example, a noble metal from Group VIIIA according to the 1975, rules of the International Union of Pure and Applied Chemistry, such as platinum or palladium on an alumina or siliceous matrix, or unsulfided Group VIIIA and Group VIB, such as nickel-molybdenum or nickel-tin on an alumina or siliceous matrix, is a suitable catalyst. U.S. Pat. No. 3,852,207 to Stangeland et al. ("Production of Stable Lubricating Oils By Sequential Hydrocracking and Hydrogenation") describes a suitable noble metal catalyst and mild conditions. Other suitable catalysts are detailed, for example, in U.S. Pat. No. 4,157,294 to Iwao, et al. ("Method of Preparing Base Stocks For Lubricating Oil"), and U.S. Pat. No. 3,904,513 to Fischer et al. ("Hydrofinishing or Petroleum"). The non-noble metal (such as nickel-molybdenum) hydrogenation metal are usually present in the final catalyst composition as oxides, or more preferably or possibly, as sulfides when such compounds are readily formed from the particular metal involved. Preferred non-noble metal overall catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalysts contain in excess of 0.01% metal, preferably between 0.1 and 1.0% metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation. Although these components can be combined with the catalyst matrix as the sulfides, that is generally not the case. They are usually added as a metal salt, which can be thermally converted to the corresponding oxide in an oxidizing atmosphere or reduced to the metal with hydrogen or other reducing agent. If necessary, the non-noble metal composition can then be sulfided by reaction with a sulfur donor such as carbon bisulfide, hydrogen sulfide, hydrocarbon thiols, elemental sulfur, and the like.

The matrix component can be of many types including some that have acidic catalytic activity. Ones that have activity include amorphous silica-alumina or may be a zeolitic or non-zeolitic crystalline molecular sieve. Examples of suitable matix molecular sieves include zeolite Y, zeolite X and the so called ultra stable zeolite Y and high structural silica:alumina ratio zeolite Y such as for example described in U.S. Pat. No. 4,401,556 to Bezman, et al. ("Midbarrel Hydrocracking"), U.S. Pat. No. 4,820,402 to Partridge, et al., ("Hydrocracking Process With Improved Distillate Selectivity With High Silica Large Pore Zeolites"), and U.S. Pat. No. 5,059,567 to Listen, et al. ("Process For The Preparation of A Modified Zeolite"). Small crystal size zeolite Y, such as described in U.S. Pat. No. 5,073,530 to Bezman, et al. ("Hydrocrackling Catalyst And Process") can also be used. Non-zeolitic molecular sieves which can be used include, for example silicoaluminophosphates (SAPO), ferroaluminophosphate, titanium aluminophosphate and the various ELAPO molecular sieves described in U.S. Pat. No. 4,913,799 to Gortsema, et al. ("Hydrocracking Catalysts And Processes Employing Non-Zeolitic Molecular Sieves") and the references cited therein. Details regarding the preparation of various non-zeolite molecular sieves can be found in U.S. Pat. No. 5,114,563 to Lok, et al. ("Hydrocarbon Conversions Using Catalysts Silicoaluminophosphates"); and in U.S. Pat. No. 4,913,799. Mesoporous molecular sieves can also be included, for example the M41S family of materials, MCM-41 (U.S. Pat. No. 5,246,689 to Beck, et al. ("Synthetic Porous Crystalline Material Its Synthesis And Use"), U.S. Pat. No. 5,198,203 to Kresge, et al. ("Synthetic Mesoporous Crystalline Material"), and U.S. Pat. No. 5,334,368 to Beck, et al. ("Synthesis of Mesoporous Oxide")), and MCM-48.

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides naturally occurring clays which can be composited with the catalyst include those of the montmorillonite and kaolin families. These clays can be used in the raw state as originally mined or initially subjected to calumniation, acid treatment, or chemical modification.

Furthermore more than one catalyst type may be used in the reactor. The different catalyst types can be separated into layers or mixed.

Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bb1, and are preferably between 1000 and 5000 SCF/Bb1. Temperatures range from about 300 F to about 750° F., preferably ranging from 450° F. to 600° F.

If it is desirable to introduce skeletal isomerization during the paraffinic feedstock hydrotreating step, or during the hydrotreating of the product from the oligomerization reactor, or during the hydrotreating of the final lube base oil range hydrocarbons, the matrix of the catalyst is chosen to facilitate this reaction. Detailed descriptions of catalysts that do this reaction are shown in U.S. Pat. Nos. 5,282,958; 5,246,566; 5,135,638 and 5,082,986 referred to in the Background of the Invention section. A molecular sieve is used as one component in the matrix. The sieve has pores of less than 7.1 Å, preferably less than 6.5 Å; and having at least one pore diameter greater than 4.8 Å, and having a crystal size no more than about 0.5 microns. The catalyst is further characterized in that it has sufficient acidity to convert at least 50% of hexadecane at 370° C., and exhibits a 40 or greater isomerization selectivity ratio as defined in U.S. Pat. No. 5,282,958 at 96% hexadecane conversion. Specific examples of molecular sieves which satisfy these requirements are ZSM-12, ZSM-21, ZSM-22, ZSM-23, ZSM-35, ZSM-38, ZSM-48, ZSM-57, SSZ-32, SSZ-35, Ferrierite, L-type zeolite, SAPO-11, SAPO-31, SAPO-41, MAPO-11 and MAPO-31.

U.S. Pat. Nos. 3,852,207; 3,904,513; 4,157,294; 4,401,556; 4,820,402; 4,913,799; 5,059,567; 5,073,530; 5,114,563; 5,198,203; 5,246,689; and 5,334,368 are hereby incorporated by reference for all purposes.

If hydrotreatment is used for purification, the hydrotreated olefinic feedstock should be dehydrogenated to replace olefins lost by the hydrotreatment process. Also, unreacted paraffins in the production from the second oligomerization zone can be dehydrogenated and recycled to the second oligomerization zone.

Dehydrogenation processes known in the art generally have employed catalysts which comprise a noble metal, usually Pt, supported on a non-acid support, typically alumina, silica, or non-acidic alumino silicate. The temperature at which paraffin dehydrogenation is normally carried out is in a range from 350° to 650° C. (preferably from 400° to 550° C.). The process is usually carried out at atmospheric pressure, although it is possible to operate at a pressure of several atmospheres, for example up to 10 atmospheres.

The linear paraffins are generally fed at a rate of from 0.001 to 100 volumes (calculated as a liquid) per hour for each volume of catalyst. Moreover, since the dehydrogenation reaction takes place in the presence of hydrogen gas, it is convenient to maintain the molar ratio of hydrogen to linear paraffin in the feed mixture at a value of from 1:1 to 50:1.

Preferably, diolefins produced during the dehydrogenation are removed by known adsorption processes or selective hydrogenation processes that selectively hydrogenate diolefins to monoolefins without significantly hydrogenating monoolefins. Suitable selective hydrogenation processes for hydrotreating diolefins to monoolefins without hydrogenating monoolefins are, for example, described in U.S. Pat. No. 4,523,045 to Vora ("Process For Converting Paraffins To Olefins"); in U.S. Pat. No. 4,523,048 to Vora ("Process For The Selective Production of Alkylbenzenes"); and U.S. Pat. No. 5,012,021 to Vora, et al. ("Process For The Production of AlkylAromatic Hydrocarbons Using Solid Catalysts"). If desired, branched hydrocarbons may be removed before or after the dehydrogenation process, typically by adsorption.

U.S. Pat. Nos. 4,523,045; 4,523,048; 5,012,021; 5,198,597; 5,741,759; 5,866,746; and 5,965,783 are hereby incorporated by reference for all purposes.

Both the light olefin fraction and a medium olefin fraction are contacted with oligomerization catalysts in oligomerization zones to produce a product having a higher number average molecular weight than the initial feedstock. Preferably, the product of the second oligomerization zone has a higher number average molecular weight at least 10% higher than the initial feedstock, more preferably at least 20% higher than the initial feedstock. Since the oligomerization catalyst can also promote skeletal isomerization of olefins, both oligomerization and skeletal isomerization can occur in the same process step.

Conditions for this reaction in the oligomerization zone are between room temperature and 400° F., from 0.1 to 3 LHSV, and from 0 to 1000 psig. Catalysts for oligomerization can be virtually any acidic material including zeolites, clays, resins, $BF_3$ complexes, HF, $H_2SO_4$, $AlCl_3$, ionic liquids (preferably acidic ionic liquids), superacids, etc. Preferably, the catalyst is a Group VIII metal on an inorganic oxide support, more preferably a Group VIII metal on a zeolite support. Zeolites are preferred because of their resistance to fouling and ease of regeneration. In one embodiment, the catalyst is nickel on ZSM-5.

Oligomerization of olefins is disclosed in U.S. Pat. Nos. 4,417,088, 4,542,251, and 5,965,783 described in the Background of the Invention section.

The oligomerization of olefins using ionic liquids is disclosed in U.S. Pat. No. 5,550,304 to Chauvin, et al. ("Nickel-Containing Composition For Catalysis And Olefin Dimerisation and Oligomerisation Process") and U.S. Pat. No. 5,502,018 to Chauvin, et al. ("Nickel-Containing Composition For Catalysis And Olefin Dimerisation and Oligomerisation Process"), which are both hereby incorporated by reference for all purposes.

In one embodiment, the oligomerization zone is located within a catalytic distillation unit used to both produce the product and separate the product into a light byproduct fraction and a heavy product fraction. In that embodiment, the olefinic feedstock can also be contacted with an oligomerization catalyst in a fixed bed prior to the catalytic distillation unit. Preferably, portions of the light byproduct fraction and the heavy product fraction are refluxed to the catalytic distillation unit. In that embodiment, the olefinic feedstock can be contacted with an oligomerization catalyst within the catalytic distillation unit or within a fixed bed.

The product of the second oligomerization zone is separated into a light byproduct fraction and a heavy product fraction, wherein the heavy product fraction includes a lube base stock. This separation can be done by conventional separation techniques, such as distillation.

That heavy product fraction includes predominately hydrocarbons in the lube base oil range that have acceptable viscosity index and viscosity for use in making finished lubes (lube base stock). Preferably, the heavy product fraction has a viscosity of greater than 2 cSt at 100° C. and a viscosity index of above 80 (more preferably above 120). A viscosity index of over 120 is preferred over a viscosity of over 80 because the higher VI oil will maintain its viscosity to a greater degree over a range of temperatures (the definition of VI). The higher VI oil will likely have higher oxidation stability. Preferably, the pour point is less than −10° C., more preferably less than −20° C.

If desired, skeletal isomerization can be induced on the heavy product fraction, using a matrix of the catalyst chosen to facilitate this reaction, as described above in the "Purification of the Feedstock By Hydrotreatment" section.

Preferably, at least a portion of the light byproduct fraction is recycled to the first oligomerization zone or to the second oligomerization zone or to both the first and second oligomerization zones or to the second separator.

Distillation bottoms can be discarded (e.g., if any solids are present), or they can be kept for subsequent processing.

Preferably, the heavy product fraction is separated into at least one of the following fractions:

a) a light lube base stock fraction having a viscosity of from 2 to 7 cSt at 100° C.;

b) a heavy lube base stock fraction having a viscosity of from 6 to 20 cSt at 100° C.; and c) a bright stock fraction having a viscosity of greater than 180 cSt at 40° C.

The specifications for lube base stocks are defined in the API Interchange Guidelines (API Publication 1509). Group II base stocks have no more than 300 ppm sulfur, have at least 90% saturates, and have viscosity indexes of from 80 to less than 120. Group II base stock constitutes about 10% of the world lube base stock production, and approximately 30% of the U.S. production.

To form Group II stocks, preferably the heavy product fraction is separated into at least one of the following fractions:

a) a light lube base stock fraction having a viscosity of from 3 to 6 cSt at 100° C., more preferably from 3.5 to 5 cSt, most preferably from 3.8 to 4.2 cSt;

b) a heavy lube base stock fraction having a viscosity of from 6 to 16 cSt at 100° C., more preferably from 9 to 13 cSt, most preferably from 11 to 12.5 cSt; and c) a bright stock fraction having a viscosity of greater than 180 cSt at 40° C., more preferably greater than 220, most preferably greater than 250 cSt.

Group III base stocks have no more than 300 ppm sulfur, have at least 90% saturates, and have viscosity indexes of 120 or more. Only a small fraction of the lube base stock production in the world is Group m base stock. To form Group III stocks, preferably the heavy product fraction is separated into at least one of the following fractions:

a) a light lube base stock fraction having a viscosity of from 3 to 7 cSt at 100° C., more preferably from 4 to 6 cSt, most preferably from 4.7 to 5.3 cSt;

b) a heavy lube base stock fraction having a viscosity of from 7 to 20 cSt at 100° C., more preferably from 10 to 15 cSt, most preferably from 12 to 13.5 cSt; and c) a bright stock fraction having a viscosity of greater than 180 cSt at 40° C., more preferably greater than 220, most preferably greater than 250 cSt.

The split between the light byproduct fraction and the heavy product fraction can be adjusted, along with the amount of recycle, to control the viscosity grade distribution of lubes products made. In one particularly preferred embodiment, the separation of fractions is adjusted so that the heavy product fraction is mainly bright stock fraction. Substantially the entire light byproduct fraction is recycled either to the dehydrogenation zone or to the oligomerization zone or to both.

Undesired buildup in any of the recycle streams can be managed by taking a bleed from the recycle stream and either using it as fuel oil or blending it into export crude.

Preferably, either the product of the second oligomerization zone or the heavy product fraction is hydrofinished to eliminate any remaining olefins. More preferably, the heavy product fraction is hydrogenated to remove any remaining olefins. Typical conditions are between 200° and 600° F., 0.1 to 3 LHSV, and 200 to 3000 psig. Catalysts useful for performing this reaction can be any NiMo supported catalyst or a Group VIII metal on a support. Preferred catalysts are platinum, palladium, or platinum-palladium alloys.

If the product of the oligomerization is hydrofinished, then at least a portion of the light byproduct fraction preferably goes to a dehydrogenation zone or, alternatively, to a purification zone, or can be used as fuel. If the heavy product fraction is hydrogenated, at least a portion of the light byproduct fraction preferably goes to the dehydrogenation zone or, alternatively, to the first purification zone or to the oligomerization zone(s), or used as fuel.

Conventional cloud point reduction processes can be used correct any unacceptable cloud point. For instance, this can be accomplished either before hydrofinishing in a separate reactor, by isomerizing the olefinic oligomer (e.g., see U.S. Pat. Nos. 5,082,986 described in the "Background of the Invention" section, and U.S. Pat. No. 5,965,783 to Gee et al., "Process For Isomerizing Olefins", which is hereby incorporated by reference for all purposes) or in the same reactor with the hydrofinishing catalyst.

EXAMPLES

The invention will be further illustrated by following examples, which set forth particularly advantageous method embodiments. While the Examples are provided to illustrate the present invention, they are not intended to limit it.

Examples one through eight show oligomerization of various feeds with various catalysts.

Example One

Oligomerization of $C_{10}$ and $C_{15-20}$ Cuts $C_{10}$ and $C_{15}$–$C_{20}$ cuts were obtained from a wax thermal cracker. Both streams contained about 88% n-alphaolefins, with the remainder being mostly paraffins and diolefins. A 3:1 mixture of the $C_{15}$–$C_{20}$/$C_{10}$ cuts was prepared, and reacted over a catalyst composed of 1% Zn on ZSM-5 bound with Catapal alumina. Reaction conditions were 300 psig, 450 F, and 0.25 LHSV. At 200 hours onstream, conversion to 700° F.+ lube was about 15%. At that point, the catalyst was rejuvenated by stripping with $H_2$ at 800° F. and the run restarted with recycle of 625° F.− material. Per pass conversion to 700° F.+ was 50–60%. Products were hydrogenated over a Ni—Mo on $SiO_2Al_2O_3$ catalyst at 550 F., 1000 psig, 1 LHSV, and 3600 SCF/bb1 $H_2$, and then fractionated by distillation into a 700–800° F. fraction (47 LV % of the 700° F.+, and a 800° F.+ fraction (53 LV %). Properties are shown below.

| Fraction | 700–800° F. | 800° F.+ |
|---|---|---|
| Pour Point, ° C. | −15 | −9 |
| Viscosity, 40° C., cSt | 11.21 | 49.98 |
| Viscosity, 100° C., cSt | 2.97 | 8.41 |
| VI | 120 | 144 |
| Oxidator BN, hr | 20+ | 20+ |

Example Two

Oligomerization of $C_{15-20}$ Cut

The catalyst of Example One was rejuvenated as described in Example One, and used to oligomerize the $C_{15}$–$C_{20}$ cut at 300 psig, 450° F., and 0.25 LHSV, with a recycle ratio of 0.9 and a 33% 625° F.− bleed. Per pass conversion to 700° F.+ was 25%. Product properties, after hydrogenation as in Example 1, were:

| | |
|---|---|
| Pour Point, ° C. | +1 |
| Viscosity, 40° C., cSt | 30.80 |
| Viscosity, 100° C., cSt | 5.90 |
| VI | 139 |
| Oxidator BN, hr | 20+ |

Example Three

Oligomerization of a $C_{10}$ Cut

The catalyst of Example Two was rejuvenated as described in Example One, and used to oligomerize the $C_{10}$ cut at 300 psig, 450° F., and 0.25 LHSV, with a recycle ratio of 0.9 and a 33% 625° F.− bleed. Per pass conversion to 700° F.+ was 12%. Product properties, after hydrogenation as in Example 1, were:

| | |
|---|---|
| Pour Point, ° C. | −43 |
| Viscosity, 40° C., cSt | 23.09 |
| 100° C., cSt | 4.329 |
| VI | 90 |

Example Four

Oligomerization of 1-Decene

1% $Et_3Al_2Cl_3$ was added to Ni—ZSM-5 (1.3% Ni, 35% Catapal alumina binder, 80 $SiO_2/Al_2O_3$ mole ratio in the zeolite). Addition was by running an $Et_3Al_2Cl_3$-hexane solution over the catalyst at 400° F. 1-Decene was fed at 300 psig, 350° F., and 0.33 LHSV. Conversion to 700° F.+ over a 325-hour run was about 36%. The product was then hydrofinished over a 0.8% Pd on SiO2-$Al_2O_3$ catalyst at 425° F., 1800 psig, 1 LHSV, and 2400 SCF/bb1 $H_2$. The product boiling point distribution was as follows:

| Yield, Wt % | |
|---|---|
| 300° F.− | 2.6 |
| 300°–350° F. | 16.0 |
| 350°–550° F. | 10.4 |
| 550°–700° F. | 35.0 |
| 700°–950° F. | 14.7 |
| 950° F.+ | 3.8 |

A 740° F.+ fraction and a 800°–900° F. fraction were evaluated. The properties are shown below:

| Fraction | 740° F. + | 800°-900° F. |
|---|---|---|
| Density, g/cc | 0.8314 | 0.8305 |
| Viscosity, cSt at | 1,381 | 1,063 |
| −18° C. | | |
| −40° C. | 16,353 | 13,534 |
| 40° C. | 32.90 | 29.50 |
| 100° C. | 5.650 | 5.208 |

-continued

| | | |
|---|---|---|
| VI | 111 | 107 |
| Pour Point, ° C. | −53 | −53 |
| Color, ASTM | <0.5 | <0.5 |
| Bromine No. | 1.1 | 5.35 |
| Evaporation at 6.5 Hr/204° C., D 972, % | 16.59 | 13.67 |
| Appearance at Day 0 | Light Floc. | Light Floc. |
| Appearance at Day 14 | Light Floc. | Light Floc. |
| Oxidator BN, hr | 14.7 | 15.5 |

Example Five

Oligomerization of 1-Decene

The $Et_3Al_2Cl_3$ level on the catalyst of Example Four was increased to 6 wt %, and the 1-decene feed restarted at the same conditions as in Example Four. Conversion to 700° F.+ was 63.4%. The product boiling point distribution was as follows:

| Yield, Wt % | |
|---|---|
| 300° F.− | 3.0 |
| 300°−350° F. | 7.9 |
| 350°−550° F. | 7.2 |
| 550°−700° F. | 18.5 |
| 700°−950° F. | 26.3 |
| 950° F.+ | 23.4 |

Example Six

Catalyst Screening for Olefin Oligomerization Using 1-Decene

A series of catalysts were evaluated for olefin oligomerization using stirred batch reactors with 1-decene as the test olefin. SAPO-11 was prepared according to patent literature. Acid clays were samples obtained from the commercial manufacturer. The pillared clays were made by pillaring monmorillonite clays with aluminum chlorhydrol solutions according to literature procedures. ETS-10 was prepared according to patent and literature examples and was ammonium-exchanged and calcined. It was an essentially non-acidic material. Al-MCM-41 was prepared according to Mobil patent examples. The $SiO_2/Al_2O_3$ was made by spray drying a co-gelled mixture made from $SiO_2$ and $Al_2O_3$ precursor compounds.

Catalysts were weighed into the reactor, which was then sealed. After drying the catalyst at 150° C. for 18 hours, 1-decene feed was added by syringe under a flow of dry nitrogen. The contents of the reactor were then stirred magnetically and heated to 150° C. The ratio of 1-decene feed to catalyst and the reaction times are given in Table 1. After the desired reaction time, the reactors were cooled and the products analyzed by gas chromatography. For each test, mole % decene conversion and dimer selectivity are shown. Dimer selectivity is defined as:

$$100 \times \text{Weight Dimer Formed/Weight 1-Decene Reacted}$$

The results show that a number of acidic oxide materials give moderate to high olefin dimerization selectivity. The other products formed are decene isomers. It is understood that results will be somewhat different when carried out at different olefin/catalyst ratio, different reaction temperatures, and different reaction times. It is also understood that results obtained in a fixed bed constant flow system may be different that those obtained in batch reactions with the same catalyst. Nonetheless, these batch reaction results can suggest catalysts that will be effective in forming olefin oligomers.

TABLE 1

| Catalyst | Catalyst Description | Reaction Time, hrs | Olefin/ CatRatio g/g | Olefin Conv., mole % | Dimer-Select., % | Pore Size |
|---|---|---|---|---|---|---|
| SAPO-11 | Silicoaluminophosphate | 19 | 1.5 | 96.0 | 42.1 | 10MR (intermediate) |
| SAPO-11 | Silicoaluminophosphate | 1 | 1.5 | 97.6 | 26.8 | 10MR (intermediate) |
| SAPO-11 | Silicoaluminophosphate | 4 | 1.5 | 83.1 | 28.3 | 10MR (intermediate) |
| SAPO-11 | Silicoaluminophosphate | 8 | 1.5 | 83.6 | 39.7 | 10MR (intermediate) |
| SAPO-11 | Silicoaluminophosphate | 12 | 1.5 | 85.2 | 37.2 | 10MR (intermediate) |
| SAPO-11 | Silicoaluminophosphate | 3 | 1.5 | 82.2 | 38.8 | 10MR (intermediate) |
| Acid Clay | Süd Chemie Tonsil COG | 24 | 3.0 | 92.7 | 58.5 | unknown |
| Acid Clay | Süd Chemie Tonsil COG14G | 24 | 3.0 | 97.0 | 58.3 | unknown |
| Acid Clay | Harshaw F24 | 24 | 3.0 | 99.3 | 40.5 | unknown |
| Pillared Clay | alumina pillared acid-leached Volclay montmorillonite clay | 24 | 3.0 | 98.5 | 64.5 | unknown |
| Pillared Clay | alumina pillared acid-leached Southern Clay Products montmorillonite clay | 24 | 3.0 | 99.3 | 61.3 | unknown |
| ETS-10 | Engelhard Titanosilicate | 22 | 3.0 | 2.4 | 56.8 | 12 MR |
| Al-MCM-41 | Mesoporous Aluminosilicate | 24 | 25.2 | 74.8 | 55.8 | Ultra Large Pore, 25 Anst. |

TABLE 1-continued

| Catalyst | Catalyst Description | Reaction Time, hrs | Olefin/ CatRatio g/g | Olefin Conv., mole % | Dimer-Select., % | Pore Size |
|---|---|---|---|---|---|---|
| MCM-22 | Aluminosilicate | 24 | 25.2 | 79.1 | 61.1 | 10 MR, 12MR |
| $SiO_2/Al_2O_3$ | Cogel | 22 | 3.0 | 76.7 | 50.0 | Ultra Large Pore, mesoporous |

The non-acidic ETS-10 showed low conversion indicating the importance of acid components in the catalyst.

Example Seven

Oligomerization of $C_{20-24}$ Olefins Over an Acidic Ionic Liquid

A commercial sample of $C_{20-24}$ Normal Alpha Olefin from Chevron Chemical Co. was converted to a substantially linear internal olefin by isomerization over $Fe(CO)_5$ supplied by Dixie Chemical Co. This is in simulation of the internal olefins that would be generated by dehydrogenation of the corresponding $C_{20-24}$ paraffin.

An acidic chloroaluminate ionic liquid was prepared according to a literature method. 1-Ethyl-3-methylimidazolium chloride and aluminum trichloride were purchased from Aldrich Chemical Company and used as received. In a dry box, two equivalents of solid aluminum trichloride were added in small portions to one equivalent of solid 1-ethyl-3-methylimidazolium chloride. As the addition proceeded, heat was evolved and the solids melted together and became fluid. After stirring at ambient temperature overnight, the liquid was filtered, giving a light brown liquid catalyst.

In four experiments roughly two parts of internal olefin and one part (by volume) of the acidic chloroaluminate ionic liquid were mixed at room temperature and 65 C. for one hour and four hours in small glass vessels. The organic phase was analyzed by a high temperature simulated distillation chromatograph to determine the boiling range of the products. Material in the lube boiling range that included dimers, trimers, tetramers and higher oligomers (material boiling above about 1200° F.) were observed in all four experiments.

Example Eight

Oligomerization of $C_{20-24}$ Olefins Over an Acidic Clay

The internal $C_{20-24}$ olefin of the previous example was oligomerized over an acid clay. The acidic clay was Harshaw F24 clay.

The olefin was contacted with the acidic clay at 180 C in a two liter three-necked round bottom flask equipped with a reflux condenser and a paddle stirrer. Heating was continued for about six hours.

The unreacted $C_{20-24}$ olefin was separated from the product mixture by distillation. The lube fraction was hydrogenated at 70 psig and room temperature using a 10 wt % Pd on carbon catalyst. Little hydrogen was consumed but the product became water white and clear. Analysis of the product by simulated distillation showed that the majority boiled from ~850° to ~1030° F., with a smaller amounts boiling range from ~1030° to 1150°. Even smaller amounts boiled higher 1200° F. The viscometric properties of the hydrogenated product were found to be:

| | |
|---|---|
| vis at 40° C.: | 54.04 cSt |
| vis at 100° C.: | 9.205 |
| VI: | 152 |
| Pour is | +7° C. |
| Cloud is | +5° C. |

Example of A Specific Embodiment

In one specific embodiment, as shown in FIG. 1, an olefinic feedstock 5 is separated in a first separator 10 into fractions comprising at least a light olefin fraction 12 having boiling points of no more than 350° F., a medium olefin fraction 14 having boiling points in the range of from 250° to 650° F., and a heavy feed fraction 16 having has boiling points of at least 650° F. The heavy feed fraction 16 is thermally cracked in cracking zone 20 to produce additional olefins 25. The additional olefins 25 are separated in a second separator 30 into an additional light olefin fraction 32 and an additional medium olefin fraction 34. The light olefin fraction 12 and the additional light olefin fraction 32 are contacted with a first oligomerization catalyst in a first oligomerization zone 40 to produce a first product 45. The medium olefin fraction 14, the additional medium olefin fraction 34, and the first product 45 are contacted with a second oligomerization catalyst in a second oligomerization zone 50 to produce a second product 55 (the first oligomerization catalyst and the second oligomerization catalyst can be the same or different). The second product 55 is separated in a third separator 60 into a light byproduct fraction 62 and a heavy product fraction 64, wherein the heavy product fraction 64 is predominately a bright stock fraction (having a viscosity of greater than 25 cSt at 100° C.). Substantially the entire light byproduct fraction 62 is recycled to the second oligomerization zone 50.

Although not shown in FIG. 1, the olefinic feedstock 5 can be purified to remove oxygenates and other impurities prior to separation. If the olefinic feedstock 5 is purified by hydrotreatment, it can be dehydrogenated prior to separation. Also not shown in FIG. 1, the light byproduct 62 can be dehydrogenated prior to being recycled to the second oligomerization zone 50. Also not shown in FIG. 1, either the product 55 or the heavy product fraction 64 should be hydrofinished.

While the present invention has been described with reference to specific embodiments, this application is intended to cover those various changes and substitutions that may be made by those skilled in the art without departing from the spirit and scope of the appended claims.

What is claimed is:

1. A process for making a lube base stock comprising:

a) separating an olefinic feedstock with boiling points greater than 180° F. in a first separator into fractions comprising at least a light olefin fraction and a medium olefin fraction;

b) contacting said light olefin fraction with a first oligomerization catalyst in a first oligomerization zone to produce a first product;

c) contacting said medium olefin fraction and said first product with a second oligomerization catalyst in a second oligomerization zone to produce a second product, wherein said first oligomerization catalyst and said second oligomerization catalyst can be the same or different; and d) separating said second product in a second separator into a light byproduct fraction and a heavy product fraction, wherein said heavy product fraction comprises a lube base stock.

2. The process of claim 1, wherein the olefinic feedstock comprises at least 30% olefins.

3. The process of claim 2, wherein said olefinic feedstock comprises at least 50% olefins.

4. The process of claim 1, wherein the boiling points of said olefinic feedstock are within the range of from 258° to 650° F.

5. The process of claim 1, wherein the boiling points of said light olefin fraction are in the range of from 50° to 350° F. and said medium olefin fraction has boiling points in the range of from 250° to 650° F.

6. The process of claim 1, wherein said olefinic feedstock is separated into fractions in a first separator comprising at least a light olefin fraction, a medium olefin fraction, and a waxy heavy fraction, wherein the boiling points of said waxy heavy fraction are at least 650° F.

7. The process of claim 1, wherein said olefinic feedstock is produced by a Fischer-Tropsch process.

8. The process of claim 1, wherein said olefinic feedstock is purified to remove oxygenates and other impurities.

9. The process of claim 1, wherein said first oligomerization catalyst and/or said second oligomerization catalyst comprise an inorganic oxide.

10. The process of claim 9, wherein said first oligomerization catalyst and/or said second oligomerization catalyst comprise a Group VIII metal on a zeolitic support.

11. The process of claim 1, wherein said first oligomerization catalyst and/or said second oligomerization catalyst comprise an acidic ionic liquid.

12. The process of claim 1, further comprising hydrofinishing said heavy product fraction.

13. The process of claim 1, wherein at least a portion of said light byproduct fraction is recycled to the first oligomerization zone, to the second oligomerization zone, to both the first and second oligomerization zones or to the second separator.

14. The process of claim 1, wherein the viscosity of said heavy products is greater than 2 cSt at 100° C., the viscosity index is at least 80, and the pour point is less than −10° C.

15. The process of claim 1, wherein the viscosity of said heavy product fraction is greater than 2 cSt at 100° C., the viscosity index is at least 120, and the pour point is less than −20° C.

16. The process of claim 1, wherein said heavy product fraction is predominately a bright stock fraction having a viscosity of greater than 180 cSt at 40° C.

17. The process of claim 1, wherein said second oligomerization zone is within a catalytic distillation unit, wherein the product of that zone is separated into said light byproduct fraction and said heavy products fraction.

18. The process of claim 17, wherein a portion of said light byproduct fraction is refluxed to said catalytic distillation unit and a portion of said heavy products fraction are refluxed to said catalytic distillation unit.

19. A hydrocarbon in the lube base oil range produced by the process comprising:

a) separating an olefinic feedstock with boiling points greater than 180° F. in a first separator into fractions comprising at least a light olefin fraction and a medium olefin fraction;

b) contacting said light olefin fraction with a first oligomerization catalyst in a first oligomerization zone to produce a first product;

c) contacting said medium olefin fraction and said first product with a second oligomerization catalyst in a second oligomerization zone to produce a second product, wherein said first oligomerization catalyst and said second oligomerization catalyst can be the same or different; and d) separating said second product in a second separator into a light byproduct fraction and a heavy product fraction, wherein said heavy product fraction comprises a lube base stock.

20. A process for making a lube base stock comprising:

a) separating an olefinic feedstock in a first separator into fractions comprising at least a light olefin fraction, a medium olefin fraction, and a first heavy waxy fraction;

b) contacting said light olefin fraction with a first oligomerization catalyst in a first oligomerization zone to produce a first product;

c) contacting said medium olefin fraction and said first product with a second oligomerization catalyst in a second oligomerization zone to produce a second product, wherein said first oligomerization catalyst and said second oligomerization catalyst can be the same or different;

d) subjecting said first heavy waxy fraction and said second product to isomerization to produce an isomerized product;

e) separating said isomerized product in a second separator into a light byproduct fraction and a heavy product fraction, wherein said heavy product fraction comprises a lube base stock; and f) recycling substantially all of said light byproduct fraction to said second oligomerization zone.

* * * * *